US009290316B2

(12) United States Patent
Van Uum et al.

(10) Patent No.: US 9,290,316 B2
(45) Date of Patent: Mar. 22, 2016

(54) ASSEMBLAGE OF CONTAINERS

(75) Inventors: Sean T. Van Uum, Cumming, GA (US); Robert P. Hieronymus, Marietta, GA (US)

(73) Assignee: GEORGIA-PACIFIC CONSUMER PRODUCTS LP, Atlanta, GA (US)

( * ) Notice: Subject to any disclaimer, the term of this patent is extended or adjusted under 35 U.S.C. 154(b) by 107 days.

(21) Appl. No.: 12/603,998

(22) Filed: Oct. 22, 2009

(65) Prior Publication Data

US 2010/0089781 A1 Apr. 15, 2010

Related U.S. Application Data

(60) Provisional application No. 61/222,660, filed on Jul. 2, 2009.

(51) Int. Cl.

| | |
|---|---|
| ***B65D 19/00*** | (2006.01) |
| ***B65D 85/62*** | (2006.01) |
| ***B65D 5/00*** | (2006.01) |
| ***B65D 71/00*** | (2006.01) |

(52) U.S. Cl.
CPC ..... *B65D 85/62* (2013.01); *B65D 5/0015* (2013.01); *B65D 71/0096* (2013.01)

(58) Field of Classification Search
USPC ..... 206/215, 449, 386, 595–600; 220/23.83; 414/799, 801–802
See application file for complete search history.

(56) References Cited

U.S. PATENT DOCUMENTS

| | | | | |
|---|---|---|---|---|
| 3,055,573 A | | 9/1962 | Carter | |
| 3,985,242 A | | 10/1976 | Schlaeger | |
| 3,986,611 A | | 10/1976 | Dreher | |
| 4,036,364 A | * | 7/1977 | Ambrose | 206/526 |
| 4,068,765 A | * | 1/1978 | Pulda | 414/792 |
| 4,201,138 A | | 5/1980 | Cox | |
| 4,292,901 A | * | 10/1981 | Cox | 108/55.1 |
| 4,365,710 A | | 12/1982 | Swanson | |
| 4,793,490 A | | 12/1988 | Evert | |

(Continued)

FOREIGN PATENT DOCUMENTS

| | | |
|---|---|---|
| DE | 10141964 A1 | 3/2003 |
| EP | 0799780 A2 | 10/1997 |

(Continued)

OTHER PUBLICATIONS

Office Action for U.S. Appl. No. 12/604,021 mailed Nov. 9, 2011.

(Continued)

*Primary Examiner* — Anthony Stashick
*Assistant Examiner* — Robert Poon
(74) *Attorney, Agent, or Firm* — William W. Letson

(57) ABSTRACT

An assemblage of containers includes a plurality of layers of containers disposed on top of and supported by a transportable platform. Each container contains a plurality of reams of paper, where each layer of the plurality of layers has a same footprint area, and where the footprint area of each layer is equal to or greater than 99% of the platform footprint area. Another assemblage of containers includes a plurality of layers of containers. Each container contains a plurality of reams of paper, and each of the plurality of layers includes nine containers, three of the nine containers having their associated longitudinal axis oriented in a first direction, and six of the nine containers having their associated longitudinal axis oriented in a second direction orthogonal to the first direction.

32 Claims, 5 Drawing Sheets

(56) References Cited

U.S. PATENT DOCUMENTS

| | | | | | |
|---|---|---|---|---|---|
| 4,852,330 | A | * | 8/1989 | Carangelo | 53/399 |
| 4,913,290 | A | | 4/1990 | de Groot | |
| 5,255,841 | A | | 10/1993 | Ritter | |
| 5,314,557 | A | | 5/1994 | Schwartz et al. | |
| 5,370,233 | A | * | 12/1994 | Schutz et al. | 206/597 |
| D359,180 | S | | 6/1995 | Bedney | |
| 5,630,692 | A | | 5/1997 | Hanaya | |
| 5,647,191 | A | | 7/1997 | Villemure | |
| 5,725,089 | A | | 3/1998 | Ravet et al. | |
| 5,749,693 | A | | 5/1998 | Hanaya | |
| 5,844,807 | A | * | 12/1998 | Anderson et al. | 700/217 |
| 5,992,735 | A | | 11/1999 | Oosterbaan | |
| 6,041,570 | A | | 3/2000 | Descalzo | |
| 6,386,824 | B1 | | 5/2002 | Pizzi et al. | |
| 6,419,090 | B1 | * | 7/2002 | Focke et al. | 206/526 |
| D479,062 | S | | 9/2003 | Meyer | |
| 7,411,602 | B2 | | 8/2008 | Stenzel et al. | |
| 7,880,907 | B2 | | 2/2011 | Sugimoto | |
| 2003/0150764 | A1 | | 8/2003 | Bevier | |
| 2004/0051328 | A1 | | 3/2004 | Cinotti et al. | |
| 2004/0124111 | A1 | | 7/2004 | Bevier | |
| 2005/0224731 | A1 | | 10/2005 | Hahn et al. | |
| 2006/0249565 | A1 | | 11/2006 | Wood et al. | |
| 2006/0272961 | A1 | * | 12/2006 | Justice et al. | 206/215 |
| 2009/0162181 | A1 | * | 6/2009 | Ryf | 414/788.1 |
| 2009/0288980 | A1 | * | 11/2009 | Hadala | 206/597 |
| 2010/0092268 | A1 | | 4/2010 | Hieronymus et al. | |
| 2010/0307943 | A1 | | 12/2010 | Hieronymus et al. | |

FOREIGN PATENT DOCUMENTS

| | | | |
|---|---|---|---|
| EP | 0896945 | A2 | 2/1999 |
| JP | 3111213 | A | 5/1991 |
| JP | 6135511 | A | 5/1994 |
| JP | 2008189369 | A | 8/2008 |

OTHER PUBLICATIONS

Office Action for U.S. Appl. No. 12/604,021 Mailed May 10, 2012.
Office Action for U.S. Appl. No. 12/604,021 Mailed Oct. 22, 2012.
Office Action for U.S. Appl. No. 12/608,163 Mailed Oct. 11, 2012.

* cited by examiner

ASSEMBLAGE OF CONTAINERS

CROSS REFERENCE TO RELATED APPLICATIONS

This application claims the benefit of U.S. Provisional Application Ser. No. 61/222,660, filed 2 Jul. 2009, which is incorporated herein by reference in its entirety.

BACKGROUND OF THE INVENTION

The present disclosure relates generally to an assemblage of containers, and particularly to an assemblage of containers containing reams of paper and supported by a shipping pallet.

Historically, the communications papers industry has used 47-inch×35½-inch (47×35½) block or stringer pallets as the primary shipping platforms for cut-size paper. The most common packaging configuration used by the paper industry is the 8.5"×11" sheet size with 500 sheets per ream and 10 reams per carton with the reams configured in two 5-ream stacks side by side. The block or stringer pallet size accommodates an 8-carton layer footprint for product that fit almost perfectly to the pallet area dimensions with minimal under-hang or over-hang of the cartons relative to the pallet. The stability of the perfect cube of product on the pallet allows the 40 carton pallet configuration (5 layers of the 8 carton footprint) to be safely stacked 3 or 4 pallets high in warehouses and easily accommodated shipment in truck and rail cars with minimal load shifting and minimal bracing to prevent product damage during transit. Over the past 20 years as cut size paper sales migrated into retail distribution channels, these customers required the use of a different pallet size, the 48-inch×40-inch GMA (Grocery Manufacturers of America) design to fit in the standard rack stacking systems routinely used for storage of all products in this industry. For operational ease, in the paper industry the same identical standard carton footprints patterns used on the block and stringer pallets were simply transferred and used routinely on the GMA pallet. In the case of the most common product packaging configuration of cut size product (the 8.5"×11", 10 ream carton), the standard 8-case layer pallet pattern configuration has usually been adopted. Because this pallet size is now larger than the footprint of the traditional 8-case layer pattern, it creates an under-hang situation of carton footprint relative to the pallet. When attempting to stack the pallets in storage without racks, the upper pallets are no longer supported to the edge of the pallet by the cartons in the lower pallet cube units, creating a less stable stacking unit. Also, during shipment the under-hang of the product on the pallet increases the opportunity for the product damage to occur due to carton shifting in the space that now exists between the carton unit blocks on the pallet, even when the pallets are touching in the load pattern.

To compensate for stacking instability and product damage, material handlers typically limit the heights at which the unit loads are stored to three unit loads per stack. However, in most cases the third unit load is pyramided, that is, it is positioned such that it straddles two side-by-side unit loads. By pyramiding, material handlers are able to store unit loads three high, but they lose ⅓ of a floor spot for every pyramided unit.

Also, to gain storage density and to make pyramiding more practical, material handlers must concentrate like SKUs in one area. This affects operational efficiency in that block storage limits the material handlers' ability to slot SKUs according to the velocity at which they flow in and out of the warehouse. This leads to longer travel distances, which in turn, adds cost by reducing efficiency and increasing truck maintenance and fuel costs.

Accordingly, there is a need in the art for palletizing a plurality of layers of containers containing reams of paper in a more ecologically friendly manner that is also suitable for stable long distance transportation and stable stacking at the destination point.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

An embodiment of the invention includes an assemblage of containers having a plurality of layers of containers disposed on top of and supported by a transportable platform. Each container contains a plurality of reams of paper, where each layer of the plurality of layers has a same footprint area, and where the footprint area of each layer is equal to or greater than 99% of the platform footprint area.

An embodiment of the invention includes an assemblage of containers having a plurality of layers of containers. Each container contains a plurality of reams of paper, and each of the plurality of layers includes nine containers, three of the nine containers having their associated longitudinal axis oriented in a first direction, and six of the nine containers having their associated longitudinal axis oriented in a second direction orthogonal to the first direction.

Another embodiment of the invention includes a container for containing a plurality of reams of paper. The container includes a base tray, and a plurality of corner supports integrally formed with and coextensive with the base tray. The base tray and the plurality of corner supports form a plurality of open sides of the container that provide access to an interior of the container.

BRIEF DESCRIPTION OF THE DRAWINGS

Referring to the exemplary drawings wherein like elements are numbered alike in the accompanying Figures.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

An embodiment of the invention, as shown and described by the various figures and accompanying text, provides an assemblage of a plurality of layers of containers on a pallet, with each container containing a plurality of reams of paper, and with the outer footprint of the assemblage being disposed on the pallet so as to minimize the underhang of the assemblage on the pallet, thereby providing an assemblage of containers on a pallet having improved stability and transportability with respect to other prior art assemblages of containers containing reams of paper. While embodiments described herein depict a ream of paper made from paper sheets having specific nominal dimensions, such as 8.5-inches by 11-inches, for example, it will be appreciated that the scope of the disclosed invention is not so limited, and is also applicable to other paper sheets having other nominal dimensions, such as 11-inches by 17-inches, or A-size, for example, when used in accordance with an embodiment of the invention.

Figure 1:
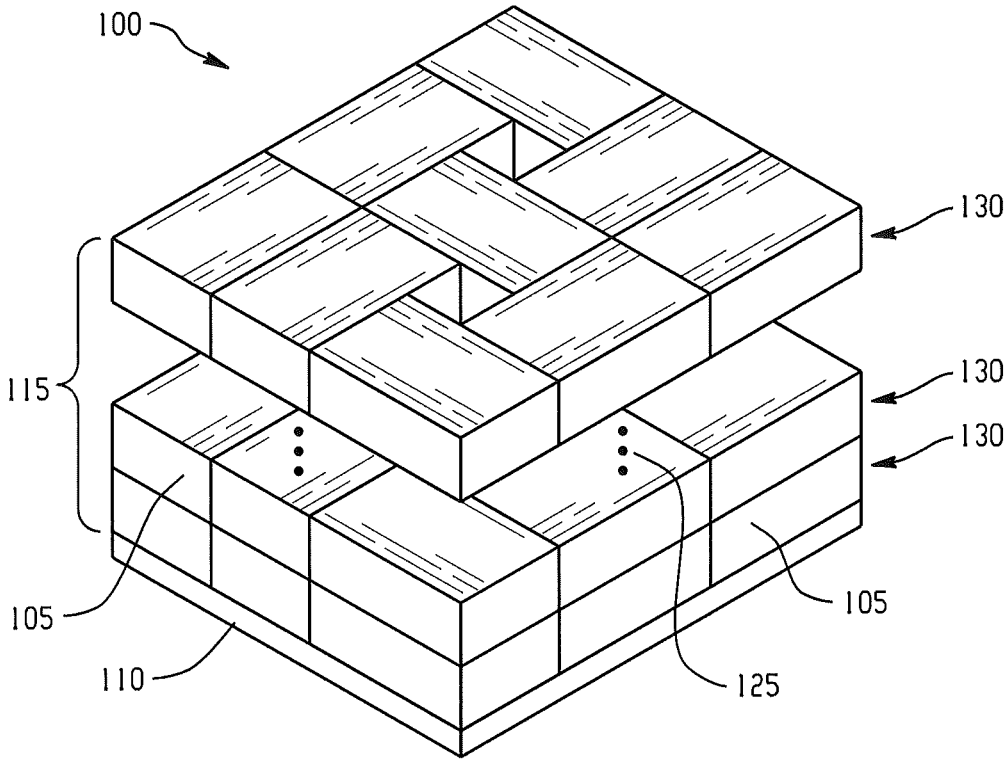
FIG. 1 depicts an isometric block diagram view of an assemblage of containers in accordance with an embodiment of the invention.

FIG. 1 is an example embodiment of an assemblage 100 of containers 105 disposed upon a pallet 110, which is also herein referred to as a transportable support platform. In an embodiment, the pallet 110 is a GMA (Grocery Manufacturers of America) pallet having industry standard nominal footprint dimensions of 40-inches by 48-inches, also known as a GMA Block pallet, which is an industry standard for pallets used in North American grocery and retail stores and warehouses. While embodiments of the invention are described herein with reference to a GMA pallet, it will be appreciated that the scope is not so limited, and that the invention also extends to other pallets when used to practice embodiments of the invention disclosed herein.

Figure 4:
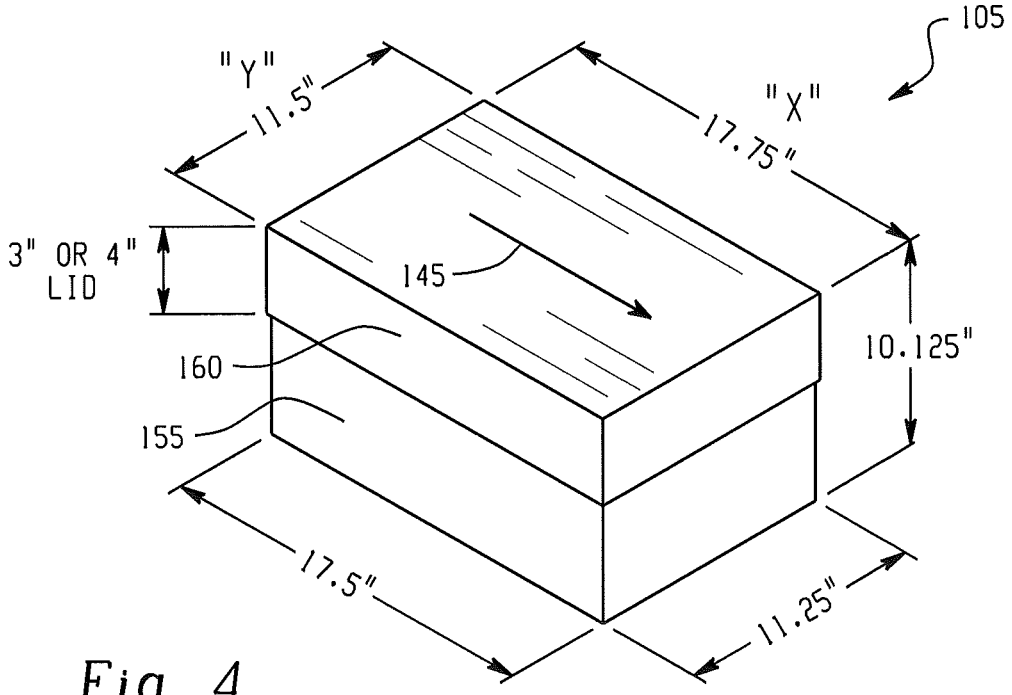
FIG. 4 depicts an isometric view of a container in accordance with an embodiment of the invention.
Figure 5:
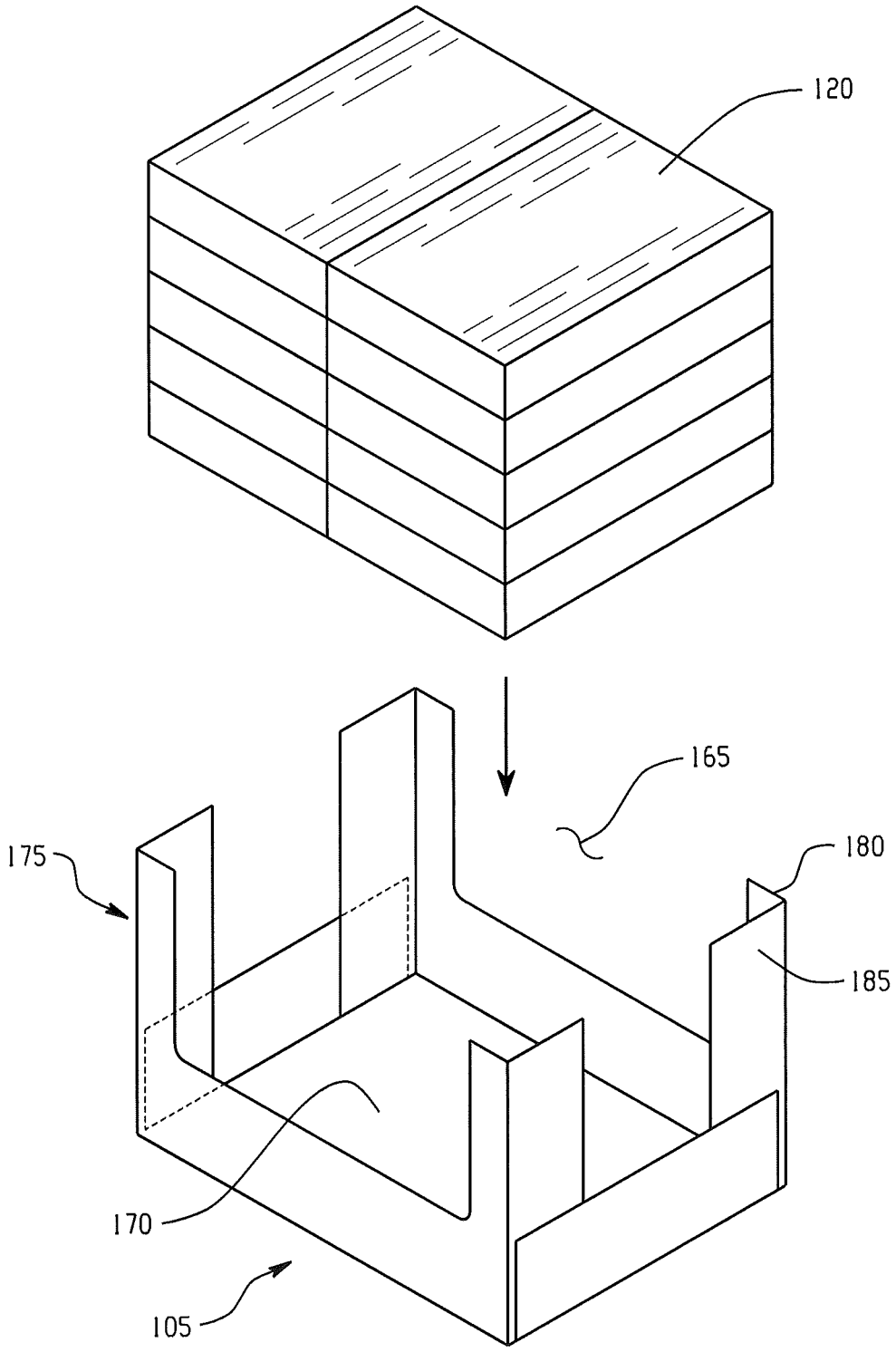
FIG. 5 depicts an isometric view of a stack of reams of paper assemblage into a container in accordance with an embodiment of the invention.

The assemblage 100 is formed by layering a plurality of layers 115 of containers 105 on top of each other, with each container containing a plurality of reams of paper 120 (see FIG. 5 for example), and with the entire plurality of layers 115 being supported by the pallet 110. In an embodiment, the plurality of reams of paper 120 has a count of ten reams, as illustrated in FIG. 5. In an embodiment, the plurality of layers 115 of containers 105 has a count of four or five layers (equal to or greater than four layers and equal to or less than five layers, for example), which is indicated by the ellipsis 125 in FIG. 1. In an embodiment, each container 105 contains a same quantity of the plurality of reams of paper 120. Container 105 may have solid walls as illustrated in FIG. 4 or open walls as illustrated in FIG. 5. With open walls as illustrated in FIG. 5, and because the carton has no lid, the reams of paper may be easily accessed from the assemblage 100 from any direction the carton is facing. With reference still to FIG. 5, at least one container 105 of the plurality of layers of containers 115, and in an embodiment each container 105 of the plurality of layers of containers, includes a plurality of open sides 165 that provide access to an interior of the one container 105, and in an embodiment, all four sides of each container 105 are open (as illustrated).

Figure 7:
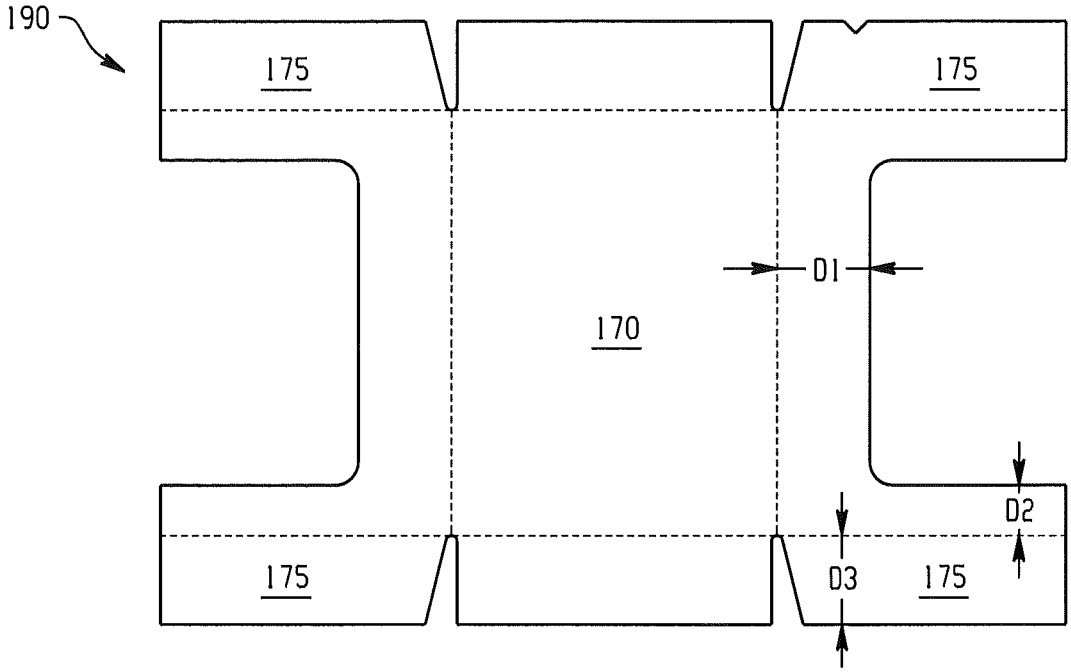
FIGS. 7 and 8 depict plan views of flat blanks suitable for forming a container in accordance with an embodiment of the invention.
Figure 8:
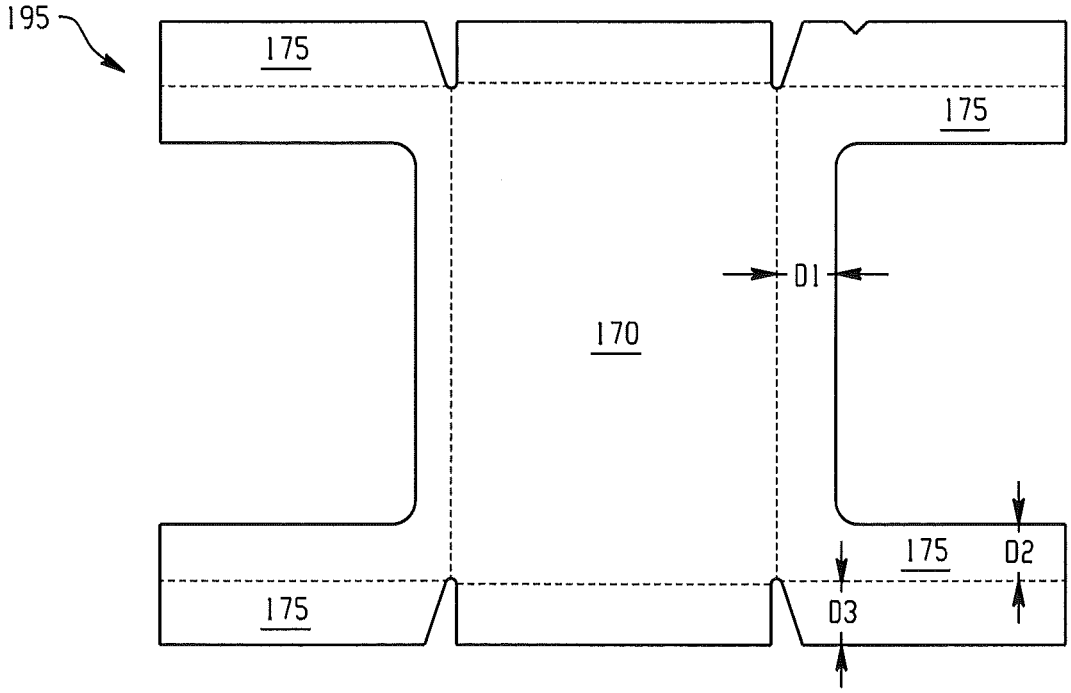

In an embodiment, the container 105 as illustrated in FIG. 5 includes a base tray 170 and four corner supports 175 extending upwardly therefrom, each of the four corner supports 175 having two integrally arranged and orthogonally disposed support faces 180, 185. As illustrated in FIG. 5, each of the plurality of corner supports 175 are connected at one end to the base tray 170, and are free floating at a second opposite end. The base tray 170 and the plurality of corner supports 175 are disposed and configured so as to support ten reams of paper 120 arranged in two side-by-side stacks of five reams each (as illustrated in FIG. 5 for example), with each ream 120 having a sheet count of at least 500 sheets of paper, and with each sheet of paper having nominal plan view dimensions of about 8½ inches by 11 inches, for example. FIGS. 7 and 8 depict alternative plan views of flat blanks 190, 195 suitable for forming the container 105 depicted in FIG. 5, where the base tray 170 and the plurality of corner supports 175 are defined by and formed from a folded flat blank of material, such as corrugated cardboard for example. Both plan views show an H-pattern formed from corrugated cardboard, with the four legs of the H-pattern forming the four corner supports 175. In general, flat blanks 190, 195 differ by the dimensions given to dimensions D1, D2 and D3, which form structural features for retaining the reams of paper 120 contained within container 105.

Figure 2:
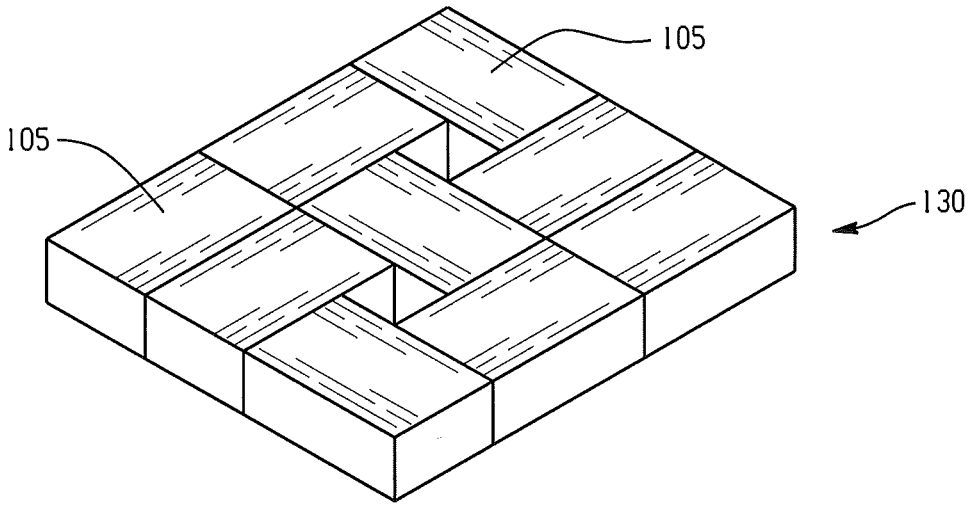
FIG. 2 depicts an isometric view of a layer of containers of the assemblage of FIG. 1.

Referring now to FIG. 2 illustrating one layer 130 of containers 105, an embodiment of the assemblage 100 has each layer of the plurality of layers 115 with a count of nine containers 105, three of the nine containers (labeled A in FIG. 3) having their associated longitudinal axis (see arrow 145 in FIG. 4) oriented in a first direction, and six of the nine containers (labeled B in FIG. 3) having their associated longitudinal axis 145 oriented in a second direction orthogonal to the first direction. More generally, and with reference to FIGS. 2-4, the plurality of containers 105 includes a first set of containers (A containers in FIG. 3) having their associated longitudinal axis 145 oriented in a first direction, and a second set of containers (B containers in FIG. 3) having their associated longitudinal axis 145 oriented in a second direction orthogonal to the first direction. In an embodiment, the plurality of containers 105 of each layer 130 have a container count that is an odd number (A count plus B count is nine in FIG. 3, for example), with the first set having a container count that is an odd number (A count is three in FIG. 3, for example), and with the second set having a container count that is an even number (B count is six in FIG. 3, for example). In an embodiment, the first set (A containers) has a container count that is one-half the container count of the second set (B containers). In an embodiment, the first set (A containers) has each associated longitudinal axis 145 oriented perpendicular to a longitudinal axis 200 of the platform (see arrow 200 in FIG. 3 depicting direction of the longitudinal axis 200), and the second set (B containers) has each associated longitudinal axis 145 oriented parallel to the longitudinal axis 200 of the platform.

Figure 3:
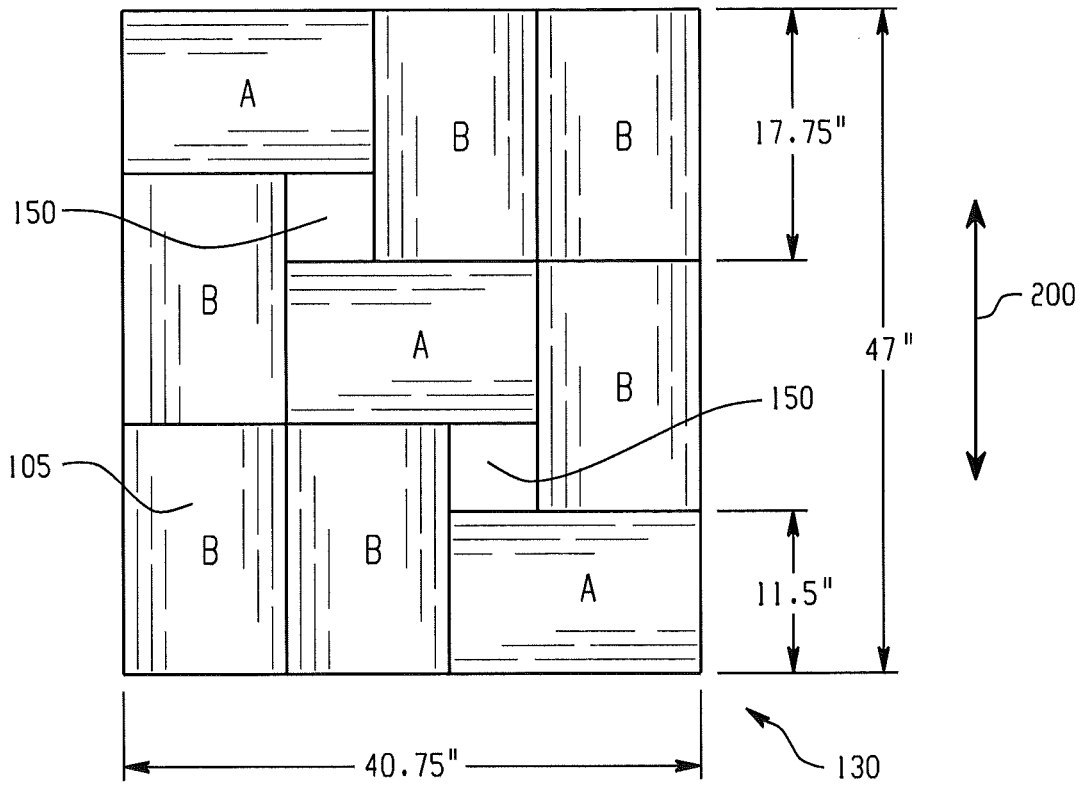
FIG. 3 depicts a plan view of the layer of FIG. 2.

With reference to FIGS. 2 and 3, FIG. 3 being a plan view of FIG. 2, each layer 130 of the plurality of layers 115 forms a rectangular perimeter defined by outer surfaces of eight of the nine containers, A-B-B-B-A-B-B-B (excluding central container A), for example. In an embodiment, the containers 105 of each layer 130 are so arranged as to form at least one square void, and more typically two square voids, 150 within the area defined by the perimeter. As can be seen by reference to FIGS. 2 and 3, a centrally disposed one of the nine containers 105 (labeled A) has its longitudinal axis oriented in a direction different from any one of the remaining eight containers 105 in close enough proximity to touch a side of the centrally disposed one container 105, which amounts to four of the eight remaining containers 105 (labeled B). Furthermore, the centrally disposed one of the nine containers 105 (labeled A) has its longitudinal axis 145 oriented in a direction different from any one of the remaining eight containers 105 in close enough proximity to touch a side or a corner of the centrally disposed one container 105, which amounts to six of the eight remaining containers 105 (labeled B). The aforementioned arrangement provides for an economical arrangement of containers 105 on a GMA pallet for both shipping and destination stacking without the need for pyramiding.

Referring now to FIG. 4, an embodiment includes container 105 having solid walls defined by a base 155 and a lid 160 formed from separate folded blanks cut from corrugated cardboard. As illustrated, an embodiment includes outer dimensions of the base 155 being 17½ inches by 11¼ inches, and outer dimensions of the lid 160 being 17¾ inches by 11½ inches, which is suitable for holding side-by-side stacks of reams of paper measuring 11 inches by 8½ inches.

Figure 6:
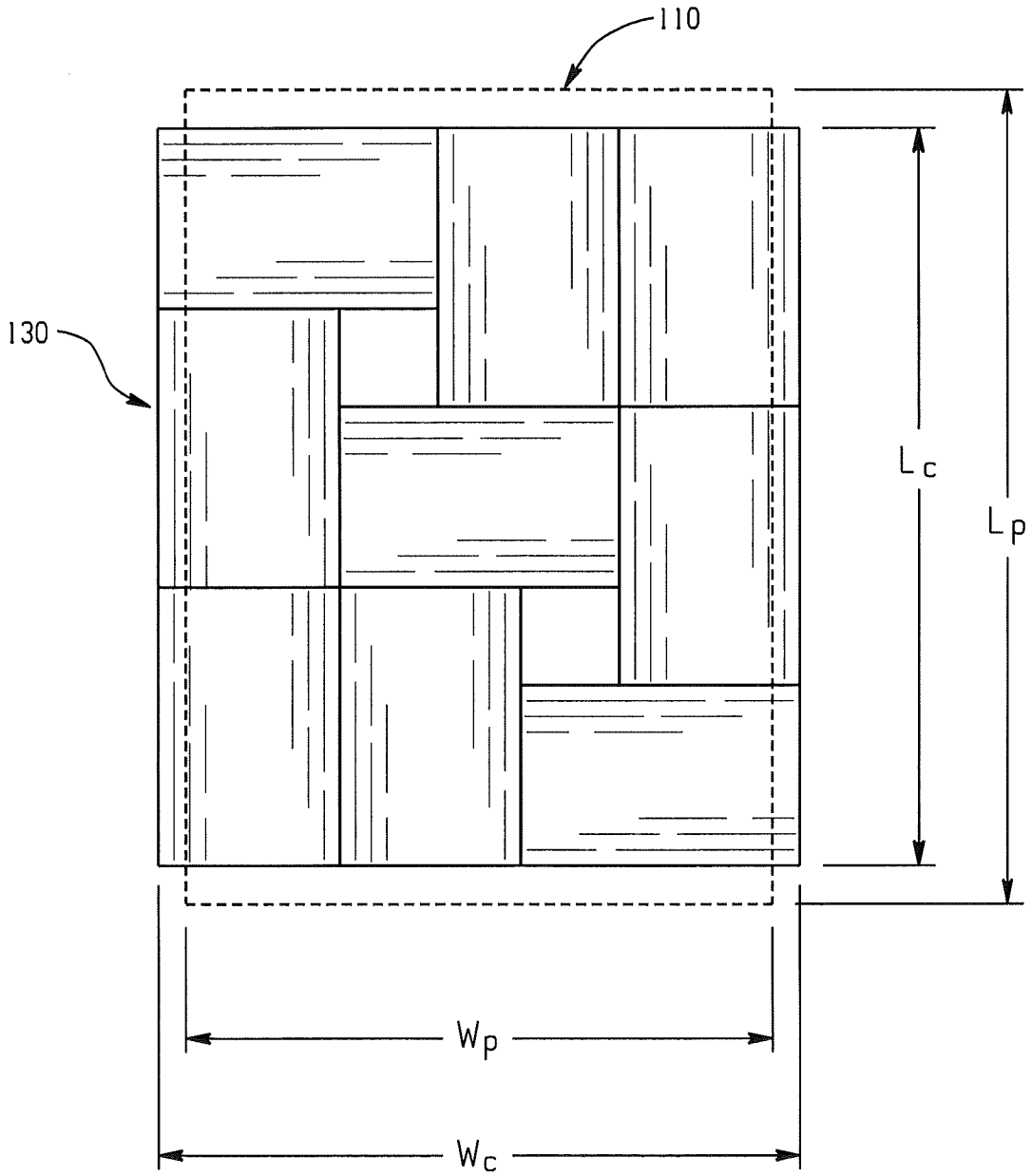
FIG. 6 depicts a plan view of a layer of a plurality of containers relative to a plan view of a pallet arranged in accordance with an embodiment of the invention.

Referring now to FIG. 6, which illustrates a plan view of the layer 130 in solid line fashion and a plan view of the pallet 110 in dashed line fashion, We represents the width of the layer 130 of containers 105, Wp represents the width of the pallet 110, Lc represents the length of the layer 130 of containers 105, and Lp represents the length of the pallet 110. From the aforementioned discussions relating to the dimensions of the containers 105 and the GMA pallet 110, the dimensions for Wc, Wp, Lc and Lp in an embodiment can be readily ascertained to be:

Wc=40¾ inches

Wp=40 inches

Lc=47 inches

Lp=48 inches.

A comparison of the dimensions illustrated in FIGS. 3 and 4 confirm the dimensions for We and Lc.

With reference to FIG. 6, it can be seen from the example presented that the width Wp of the pallet 110 is slightly less (by about ⅜ inches per side in the example illustrated) than the width We of the layer 130 of containers 105, resulting in a slight overhang on each side, and that the length Lp of the pallet 110 is slightly greater (by about ½ inches per end in the example illustrated) than the Lc of the layer 130 of containers 105, resulting in a slight underhang on each end. By selectively arranging the containers 105 as described herein and presented by example illustration, the amount of underhang of containers 105 on a pallet 110, such as GMA pallet 110 for example, can be minimized with minimal overhang, thereby providing an improved pallet stacking configuration that can be tightly arranged side-by-side in a shipping container, such as tractor trailer or rail car for example, with very little space therebetween to reduce the likelihood of sideways shifting during transit. By matching the pallet area footprint as much as possible with the carton layer configuration footprint to minimize underhang, an assemblage of containers 105 on a pallet 110 is achieved having improved stability and transportability with respect to other prior art assemblages of containers containing reams of paper. As will be appreciated, it is desirable to avoid any significant overhang of the cartons relative to the pallet 110, as an excessive overhang opens opportunity for product damage. The amount of overhang described and illustrated herein (⅜ inches per side for example), has been shown to be acceptable for the purposes disclosed herein.

In view of the foregoing, it will be appreciated that an embodiment includes a footprint of the plurality of layers of containers having an overall area Wc×Lc of 1,915.25 square-inches, which is 99.75% (greater than 99%) of the pallet footprint having an overall area Wp×Lp of 1,920 square-inches. Stated alternatively, and since Wc is greater than Wp by ¾ inches, it is also accurate to say that the footprint of the plurality of layers covers 97.9% (at least 97%) of the platform footprint area: (40×47)/(40×48)=97.9%.

Container 105 may be sized to hold reams of paper 120 made from paper sheets having specific nominal dimensions, such as 8.5-inches by 11-inches, for example. However, it will be appreciated that the disclosed invention is not so limited to just one paper size, and is also applicable to other paper sheets having other nominal dimensions, such as 11-inches by 17-inches, or A-size, for example, when used in accordance with an embodiment of the invention.

As disclosed, some embodiments of the invention may include some of the following advantages: reduced customer transactions due to economy of shipping; reduced storage costs and square footage requirements (stack units 4-5 levels high); reduced storage and handling costs by eliminating 2-2-1 stacking with 3$^{rd}$ level pyramiding; reduced labor costs through improved handling efficiency (less put-away and retrieval trips); reduced pallet volume requirements and costs; reduced lift truck maintenance and fuel costs through reduced travel distances; and, reduced freight costs through improved trailer weight utilization.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An assemblage of containers, comprising:

a GMA pallet;

a plurality of layers of containers disposed on the GMA pallet, each container being of the same dimension and having a long side and a short side and containing a plurality of reams of paper;

wherein each layer comprises nine containers, three of the nine containers having their associated long side oriented in a first direction, and six of the nine containers having their associated long side oriented in a second direction, wherein the second direction is orthogonal to the first direction, and wherein the orientation of the nine containers is the same for each layer;

wherein each layer forms a contiguous perimeter defined by outer surfaces of eight of the nine containers, wherein each container around the perimeter contacts an adjacent one of the eight containers around the perimeter, wherein the contiguous perimeter is rectangular and each side of the contiguous perimeter is formed from the long and short sides of the containers, and wherein the contiguous perimeter surrounds a single centrally disposed container that is the ninth of the nine containers, wherein the single centrally disposed container is one of the three containers having its long side oriented in the first direction, and wherein the single centrally disposed container contacts all six containers having their long side oriented in the second direction.

2. The assemblage of claim 1, wherein each container contains the same number of reams of paper.

3. The assemblage of claim 1, further comprising at least one square void adjacent the centrally disposed container within the perimeter of each layer.

4. The assemblage of claim 3, further comprising two square voids on opposite sides of the centrally disposed container within the perimeter of each layer.

5. The assemblage of claim 1, wherein the plurality of layers is four or five layers.

6. The assemblage of claim 1, wherein the plurality of layers are disposed on top of and supported by the GMA pallet, and wherein a footprint of the plurality of layers has an overall area that is greater than 99% of the area of the GMA pallet footprint.

7. The assemblage of claim 1, wherein the plurality of layers are disposed on top of and supported by the GMA pallet, and wherein a footprint of the plurality of layers covers at least 97% of the area of the GMA pallet footprint.

8. The assemblage of claim 1, wherein at least one container of the plurality of layers of containers comprises a plurality of open sides that provide access to an interior of the one container.

9. The assemblage of claim 8, wherein the at least one container of the plurality of layers of containers comprises four open sides.

10. The assemblage of claim 1, wherein each container of the plurality of layers of containers comprises a plurality of open sides that provide access to an interior of each container.

11. The assemblage of claim 10, wherein each container of the plurality of layers of containers comprises four open sides.

12. The assemblage of claim 1, wherein each container of the plurality of layers of containers is defined by a nominal length dimension of equal to or less than 17¾ inches and a nominal width dimension of equal to or less than 11½ inches.

13. The assemblage of claim 10, wherein each container of the plurality of layers of containers is defined by a nominal length dimension of equal to or less than 17¾ inches and a nominal width dimension of equal to or less than 11½ inches.

14. The assemblage of claim 9, wherein the at least one container comprises a base tray and four corner supports extending upwardly therefrom, each of the four corner supports comprising two integrally arranged and orthogonally disposed support faces.

15. An assemblage of containers, comprising:

a plurality of layers of containers, each container being of the same dimension and having a long side and a short side and containing a plurality of reams of paper, each layer having a same footprint area;

a transportable support platform having a platform footprint with a platform footprint area;

wherein the plurality of layers of containers are disposed on top of and supported by the platform;

wherein the footprint area of each layer is equal to or greater than 99% of the platform footprint area;

wherein the platform is a GMA pallet;

wherein each of the plurality of layers comprises nine containers, three of the nine containers having their long side oriented in a first direction, and six of the nine containers having their long side oriented in a second direction orthogonal to the first direction, wherein the orientation of the nine containers is the same for each layer;

wherein each layer forms a contiguous perimeter defined by outer surfaces of eight of the nine containers, each container around the perimeter disposed in contact with an adjacent one of the eight containers, wherein the contiguous perimeter is rectangular and each side of the contiguous perimeter is formed from the long and short sides of the containers, and wherein the contiguous perimeter surrounds a single centrally disposed container that is the ninth of the nine containers, wherein the single centrally disposed container is one of the three containers having its long side oriented in the first direction, and wherein the single centrally disposed container contacts all six containers having their long sides oriented in the second direction.

16. The assemblage of claim 6, each ream of paper of the plurality of reams of paper has nominal dimensions of 8.5 inches by 11 inches.

17. The assemblage of claim 15, wherein each ream of paper of the plurality of reams of paper has nominal dimensions of 8.5 inches by 11 inches.

18. The assemblage of claim 15, wherein each container contains the same number of reams of paper.

19. The assemblage of claim 15, further comprising at least one square void adjacent the centrally disposed container within the contiguous perimeter.

20. The assemblage of claim 15, further comprising two square voids on opposite sides of the centrally disposed container within the contiguous perimeter.

21. The assemblage of claim 15, wherein the plurality of layers is four or five layers.

22. The assemblage of claim 15, wherein the plurality of layers are disposed on top of and supported by the GMA pallet, and wherein a footprint of the plurality of layers has an overall area that is greater than 97% of the area of the GMA pallet footprint.

23. The assemblage of claim 15, wherein the plurality of layers are disposed on top of and supported by the GMA pallet, and wherein a footprint of the plurality of layers has an overall area that is greater than 99% of the area of the GMA pallet footprint.

24. The assemblage of claim 15, wherein a length of the plurality of layers is shorter than a length of the pallet resulting in an underhang and a width of the plurality of layers is greater than a width of the pallet resulting in an overhang.

25. The assemblage of claim 15, wherein a length of the plurality of layers is shorter than a length of the pallet by about 0.5 inches per side and a width of the plurality of layers is greater than a width of the pallet by about 0.375 inches per side.

26. An assemblage of containers, comprising:

a GMA pallet having a pallet footprint area;

a plurality of layers of containers disposed on the GMA pallet, each container being of the same dimension and having a long side and a short side and containing a plurality of reams of paper;

wherein each layer comprises nine containers, three of the nine containers having their associated longitudinal axis oriented in a first direction, and six of the nine containers having their associated longitudinal axis oriented in a second direction orthogonal to the first direction, wherein the orientation of the nine containers is the same for each layer;

wherein each layer has a contiguous perimeter defined by eight of the nine containers;

wherein each of the eight containers of the contiguous perimeter contacts its adjacent container;

wherein the contiguous perimeter is rectangular and each side of the contiguous perimeter is formed from the long and short sides of the containers;

wherein the contiguous perimeter surrounds a single centrally disposed container and two square voids on opposite sides of the centrally disposed container;

wherein the single centrally disposed container is one of the three containers having its longitudinal axis oriented in the first direction, and the single centrally disposed container contacts all six containers having their longitudinal axis oriented in the second direction;

wherein each ream of paper of the plurality of reams of paper has nominal dimensions of 8.5 inches by 11 inches;

wherein the plurality of layers are disposed on top of and supported by the GMA pallet;

wherein a length of the plurality of layers is shorter than a length of the GMA pallet resulting in an underhang and a width of the plurality of layers is greater than a width of the GMA pallet resulting in an overhang; and wherein a footprint of the plurality of layers has an overall area that is greater than 97% of the area of the GMA pallet footprint.

27. The assemblage of claim 26, wherein each container contains the same number of reams of paper.

28. The assemblage of claim 26, wherein the plurality of layers comprises four layers.

29. The assemblage of claim 26, wherein the plurality of layers comprises five layers.

30. The assemblage of claim 26, wherein the footprint of the plurality of layers has an overall area that is greater than 99% of the area of the GMA pallet footprint.

31. The assemblage of claim 26, wherein the length of the plurality of layers is shorter than the length of the pallet by about 0.5 inches per side and the width of the plurality of layers is greater than the width of the pallet by about 0.375 inches per side.

32. The assemblage of claim 26, wherein a footprint of the plurality of layers has an overall area that is greater than 99% of the area of the GMA pallet footprint.

* * * * *